US005901712A

United States Patent [19]

St. Peter

[11] Patent Number: 5,901,712

[45] Date of Patent: May 11, 1999

[54] CURLING IRON CORD STORAGE DEVICE

[76] Inventor: Lawrence A. St. Peter, P.O. Box 502, 521 Division St., Hubbell, Mich. 49934

[21] Appl. No.: 09/154,264

[22] Filed: Sep. 16, 1998

[51] Int. Cl.[6] ..... A45D 1/00; F16L 3/00

[52] U.S. Cl. ..... 132/232; 248/52; 191/12.4

[58] Field of Search ..... 132/232, 234; 248/51, 52; 242/129, 916; 24/457, 570, 17 A; 191/12.4

[56] References Cited

U.S. PATENT DOCUMENTS

| | | | |
|---|---|---|---|
| 878,394 | 2/1908 | Holle | 242/129 |
| 1,719,766 | 7/1929 | Hopkins | 248/52 |
| 4,308,878 | 1/1982 | Silva | 132/234 |
| 4,506,853 | 3/1985 | Cathey | 242/129 |
| 4,585,194 | 4/1986 | Schwob | 191/12.4 |
| 5,180,324 | 1/1993 | Simmons | 132/232 |
| 5,502,877 | 4/1996 | Yocum | 24/17 A |

*Primary Examiner*—Todd E. Manahan
*Attorney, Agent, or Firm*—Michael Best & Friedrich LLP

[57] ABSTRACT

A curling iron attachment is provided to assist in storing the electrical cord of a curling iron. The curling iron attachment includes an elongated rod receiving member, a cord wrap member extending upward from the rod receiving member, and a tongue attached to the lower portion of the cord wrap member. The elongated rod receiving member is inserted between the heating rod of a curling iron and the clamp piece of the curling iron. The tongue is capable of engaging the tip of the clamp piece. The electrical cord of the curling iron is then wrapped back and forth between the cord wrap member and the thumb lever of the curling iron. The plug is then tucked into the cord windings.

17 Claims, 2 Drawing Sheets

20
22
24
26
28
30
32
34
36
38
40
42
44
46
H
G
T
C
P
R

CURLING IRON CORD STORAGE DEVICE

FIELD OF INVENTION

The present invention relates to an attachment for curling irons designed to assist storage of the electrical cord on the curling iron.

BACKGROUND

As a small electrical appliance, a curling iron is typically equipped with an elongated electrical cord having a plug adapted for an electrical outlet. After disconnection from the electrical outlet, the cord may become entangled upon storage.

Typically, the cord is stored by simply wadding the cord in disoriented positions near the appliance, which does not afford neatly organized storage; or by wrapping the cord around the appliance itself, which can cause the cord to be wound so tightly that it remains curled in a spiral when unwound and may cause undue wear on the cord over time.

U.S. Pat. No. 5,502,877 to Yocum shows an electrical utensil cord-anchoring device which holds the cord in place after wrapping it around the body of an electrical appliance. Utilizing this device with curling irons will result in the same problems discussed immediately above.

One storage solution is a product for curling irons in which the curling iron is placed in a porcelain receptacle and the cord is wrapped around a spool near the receptacle. This storage device, however, requires mounting on a wall and is therefore not portable.

U.S. Pat. No. 4,308,878 to Silva shows a curling iron holder which has a pair of cord cleats on the exterior surface. Cleats made out of plastic material, as described in U.S. Pat. No. 4,308,878, tend to break off after extended use.

It would be desirable to have a durable, compact device specifically designed for curling irons, which facilitates neat and portable storage of the curling iron cord.

SUMMARY OF INVENTION

The present invention is a curling iron attachment designed to assist in storing the curling iron cord, thus preventing the cord from tangling. The cord storage device includes an elongated rod receiving member and a cord wrap member. The elongated rod receiving member is inserted between the heating rod of a curling iron and the clamp piece of the curling iron. The electrical cord of the curling iron is then wrapped back and forth between the cord wrap member and the thumb lever of the curling iron. The plug is then tucked into the cord windings.

According to one embodiment of the present invention, the rod receiving member has a first end and a second end, and has a top surface and a bottom surface. When in use, the bottom surface is in contact with the rod of the curling iron, and the top surface is in contact with the clamp piece of the curling iron, such that the rod receiving member is held securely in place with the first end of the rod receiving member being positioned toward the handle of the curling iron. The cord wrap member has an upper portion and a lower portion, and extends upward from the second end of the rod receiving member.

According to another embodiment of the invention, the cord storage device includes an elongated rod receiving member having a first end and a second end, and having a top surface and a bottom surface; a cord wrap member having an upper portion and a lower portion, the cord wrap member extending upward from the second end of the rod receiving member; and a tongue attached to the lower portion of the cord wrap member and extending toward the top surface of the rod receiving member.

DETAILED DESCRIPTION OF THE INVENTION

Figures 1, 2, 3, 4:
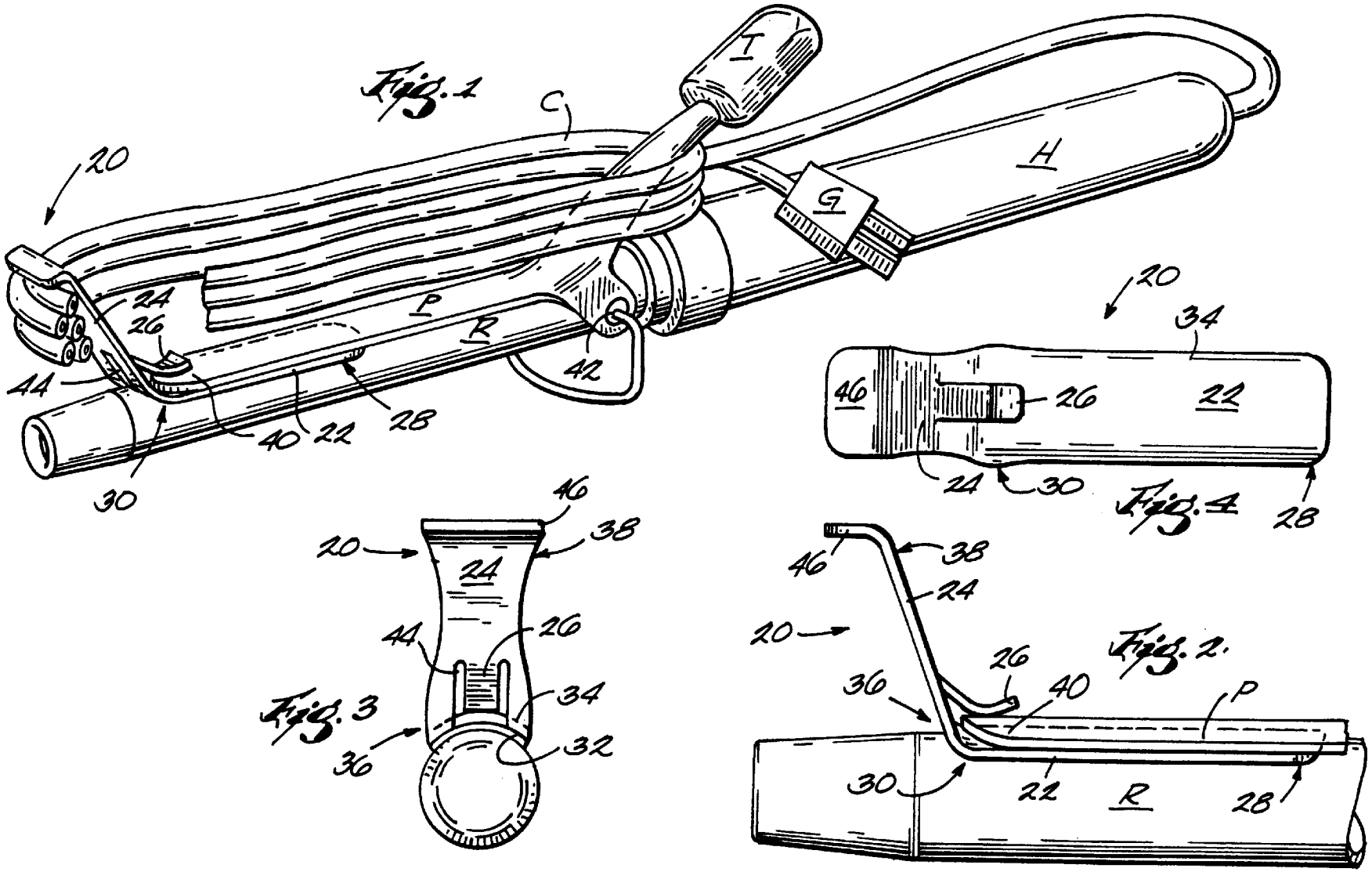
FIG. 1 is a view of a cord storage device in use on a curling iron with the electrical cord wound for storage.
FIG. 2 is a side view of the cord storage device depicted in FIG. 1, without the electrical cord.
FIG. 3 is an end view of the device of FIG. 2.
FIG. 4 is a top view of the device of FIG. 2, without the curling iron.

To assist in understanding the invention, the same reference numerals have been employed in all figures for corresponding elements. Referring more particularly to the figures, reference numeral 20 generally indicates a curling iron cord storage device in accordance with the invention. The cord storage device is preferably made of a single piece of a suitable rigid material, such as a metal or a plastic. Cord storage device 20 is adapted to be employed with a conventional curling iron of the type shown in FIG. 1 which has a handle H, a rod R extending from one end of the handle H and containing a heating element, an electrical cord C extending from an opposite end of the handle, a clamp piece P which is spring biased into contact with rod R, and a thumb lever T to afford outward pivotal movement of the clamp piece. The device 20 is attachable to curling irons of various sizes and styles.

The cord storage device 20 generally includes an elongated rod receiving member 22, a cord wrap member 24, and, preferably, a tongue or clip means 26. The rod receiving member 22 has a first end 28 and a second end 30, and has a bottom surface 32 and a top surface 34.

The cord wrap member 24 has a lower portion 36 and an upper portion 38, and extends upward from the second end 30 of the rod receiving member 22. FIG. 2 shows a tongue 26 attached to the lower portion 36 of the cord wrap member 24 and extending toward the top surface 34 of the rod receiving member 22.

The length of the rod receiving member 22 from the first end 28 to the point of attachment to the cord wrap member 24 is less than the distance between the tip 40 of the clamp piece P and the pivot point 42 of the clamp piece P. The rod receiving member 22 is sufficiently long to securely hold the device 20 in place between the clamp piece P and the rod R of the curling iron.

Preferably, the bottom surface 32 of the rod receiving member 22 is concave. The concave bottom surface 32 defines a channel which, when axially aligned with the rod R, is adapted to seat the rod R of the curling iron.

Preferably, the top surface 34 of the rod receiving member 22 is convex. As shown in FIG. 1, the concave bottom surface 32 is in contact with the rod R of the curling iron, and the convex top surface 34 is in contact with the clamp piece P such that the rod receiving member 22 is held securely in place with the first end 28 of the rod receiving member 22 being positioned toward the handle H.

With respect to the cord wrap member 24, the length and position of the cord wrap member 24 relative to the rod receiving member 22 permits a cord C from the curling iron to be wrapped back and forth around the cord wrap member 24 and a thumb lever T of the curling iron.

Preferably, the cord wrap member 24 is positioned at an angle of from about 45 degrees to about 175 degrees from the rod receiving member 22; more preferably, from about 85 degrees to about 115 degrees from the rod receiving member 22.

Figure 7:
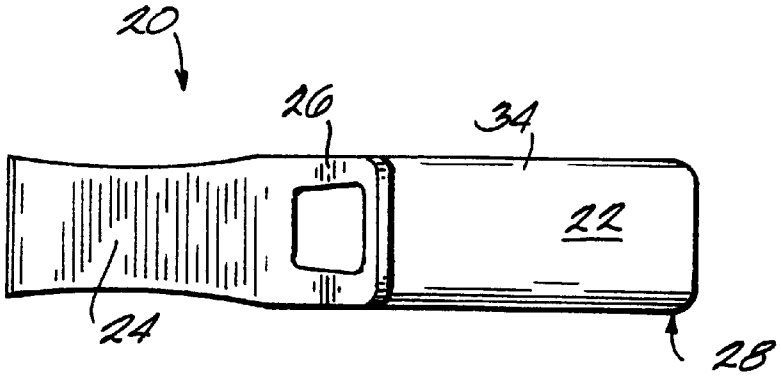
FIG. 7 is a top view of the device of FIG. 5, without the curling iron.
Figure 5:
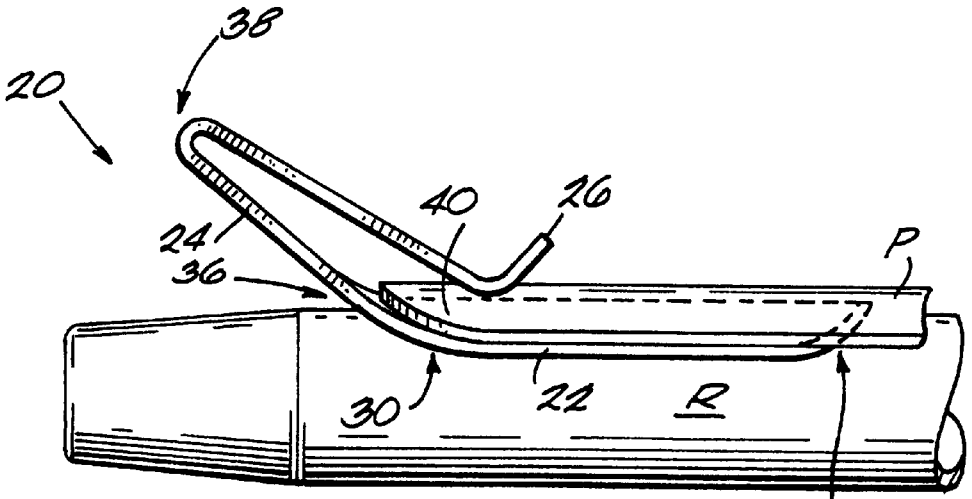
FIG. 5 is a side view of another embodiment of the cord storage device attached to a curling iron.
Figure 6:
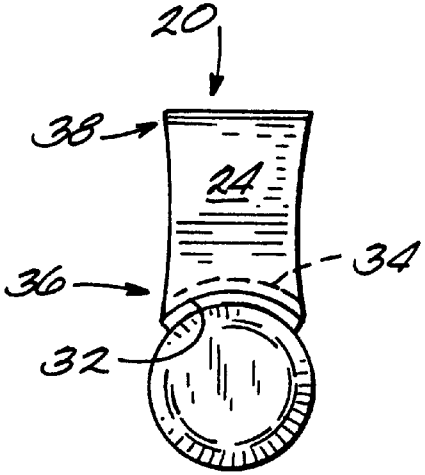
FIG. 6 is an end view of the device of FIG. 5.

In an alternative embodiment depicted in FIGS. 5–7, the cord wrap member 24 is bent such that one end of the cord wrap member 24 connects to the second end 30 of the rod receiving member 22 and the other end of the cord wrap member 24 is attached to a clip means 26.

Preferably, as shown in FIGS. 1–4, the cord storage device 20 includes a ledge 46 extending outwardly from the upper portion 38 of the cord wrap member 24.

Turning now to the clip means 26, the clip means 26 is preferably attached near the lower portion 36 of the cord wrap member 24, and is capable of engaging a tip 40 of a clamp piece P of the curling iron. To accomplish this, the clip means 26 may be spaced a sufficient distance from the rod receiving member 22 to receive the tip 40 of the clamp piece P of a conventional curling iron. Thus, if the distance (taken perpendicular to the axis of the rod R) between the lowermost part of the clip means 26 and the upper surface of the rod receiving member 34 is less than the thickness of the tip 40 of the clamp piece P, then the clip means should be flexible enough to accommodate the tip 40 of the clamp piece P.

Preferably, the clip means 26 is a tongue 26. In a highly preferred embodiment as shown in FIGS. 1–4, the tongue 26 is formed from a notch 44 at a junction between the rod receiving member 22 and the cord wrap member 24. The tongue 26 preferably extends toward the convex top surface of the rod receiving member 34. The convex top surface 34 of the rod receiving member 34 and the tongue 26 thereby define a slot into which the tip 40 of the clamp piece P may be inserted. Therefore, the clip means 26 holds the cord storage device 20 into engagement with the clamp piece P. The clip means 26 should hold the device 20 snugly to, but releasable from, the clamp piece P.

The cord storage device 20 may be employed as follows. The device 20 is placed on the curling iron by opening the clamp piece P with the thumb lever T, sliding the first end of the device 20 along the concave channel of the clamp piece P such that the convex top surface of the device 20 contacts the concave channel of the clamp piece P, and closing the clamp piece P so the rod receiving member 22 is held in place between the clamp piece P and the rod R. When the device 20 has a clip means 26, the device 20 may be placed on the curling iron as described above except that the clip means 26 engages the tip 40 of the clamp piece P.

The electrical cord C is wrapped back and forth around the cord wrap member 24 and the thumb lever T of the curling iron. The plug is then tucked into the cord windings.

What is claimed is:

1. A cord storage device for a curling iron, the cord storage device comprising:

an elongated rod receiving member having a first end and a second end, and having a top surface and a bottom surface;

a cord wrap member having an lower portion and an upper portion, the cord wrap member extending upward from the second end of the rod receiving member; and a tongue attached to the lower portion of the cord wrap member and extending toward the top surface of the rod receiving member.

2. The cord storage device of claim 1 wherein the bottom surface of the rod receiving member is concave.

3. The cord storage device of claim 1 wherein the top surface of the rod receiving member is convex.

4. The cord storage device of claim 1 further comprising a ledge extending outwardly from the upper portion of the cord wrap member.

5. The cord storage device of claim 1 wherein the cord wrap member is positioned at an angle of from about 45 degrees to about 175 degrees from the rod receiving member.

6. The cord storage device of claim 1 wherein the cord wrap member is positioned at an angle of from about 85 degrees to about 115 degrees from the rod receiving member.

7. The cord storage device of claim 1 wherein the tongue is formed from a notch at a junction between the rod receiving member and the cord wrap member.

8. The cord storage device of claim 1 wherein the cord wrap member is bent such that one end of the cord wrap member connects with the second end of the rod receiving member and the other end of the cord wrap member is attached to the tongue.

9. A cord storage device for a curling iron having a cord, a thumb lever, and a clamp piece having a tip, the cord storage device comprising:

an elongated rod receiving member having a first end and a second end, and having a concave bottom surface and a convex top surface;

a cord wrap member having an lower portion and an upper portion, the cord wrap member extending upward from the second end of the rod receiving member; and a clip means attached to the cord wrap member, the clip means being capable of engaging the tip of the clamp piece of the curling iron.

10. The cord storage device of claim 9 further comprising a ledge extending outwardly from the upper portion of the cord wrap member.

11. The cord storage device of claim 9 wherein the length and position of the cord wrap member relative to the rod receiving member permits the cord from the curling iron to be wrapped back and forth around the cord wrap member and the thumb lever of the curling iron.

12. The cord storage device of claim 11 wherein the cord wrap member is positioned at an angle of from about 85 degrees to about 115 degrees from the rod receiving member.

13. A cord storage device for a curling iron having a handle, a rod extending from one end of the handle, a electrical cord extending from an opposite end of the handle, a clamp piece which is spring biased into contact with the rod, and a thumb lever which affords outward pivotal movement of the clamp piece, the cord storage device comprising:

an elongated rod receiving member having a first end and a second end, and having a concave bottom surface and a convex top surface, the concave bottom surface being in contact with the rod of the curling iron, and the convex top surface being in contact with the clamp piece such that the rod receiving member is held securely in place with the first end of the rod receiving member being positioned toward the handle; and a cord wrap member having a lower portion and an upper portion, the cord wrap member extending upward from the second end of the rod receiving member.

14. The cord storage device of claim 13 further comprising a ledge extending outwardly from the upper portion of the cord wrap member.

15. The cord storage device of claim 13 wherein the electrical cord is wrapped back and forth around the cord wrap member and the thumb lever of the curling iron.

16. The cord storage device of claim 13 further comprising a tongue attached to the lower portion of the cord wrap member and extending toward the convex top surface of the rod receiving member.

17. The cord storage device of claim 16 wherein the tongue and the top surface of the rod receiving member define a slot into which a tip of the clamp piece is insertable.

* * * * *